US006667585B2

(12) United States Patent
O'Meara

(10) Patent No.: US 6,667,585 B2
(45) Date of Patent: Dec. 23, 2003

(54) FLUORESCENT LAMP BRIGHTNESS CONTROL PROCESS BY BALLAST FREQUENCY ADJUSTMENT

(75) Inventor: Kevan O'Meara, Chatsworth, CA (US)

(73) Assignee: Northrop Grumman Corporation, Woodland Hills, CA (US)

( * ) Notice: Subject to any disclaimer, the term of this patent is extended or adjusted under 35 U.S.C. 154(b) by 0 days.

(21) Appl. No.: 10/079,182

(22) Filed: Feb. 20, 2002

(65) Prior Publication Data

US 2003/0155873 A1 Aug. 21, 2003

(51) Int. Cl.[7] ..... H05B 37/02
(52) U.S. Cl. ..... 315/291; 315/307
(58) Field of Search ..... 315/291, DIG. 4, 315/194, 223, 307, 308, 246, 248, 209 R, 212, DIG. 5; H05B 37/02

(56) References Cited

U.S. PATENT DOCUMENTS 4,734,650 A * 3/1988 Alley et al. ..... 324/414
5,933,340 A * 8/1999 Adamson ..... 363/97
6,072,282 A * 6/2000 Adamson ..... 315/276
6,150,775 A * 11/2000 Kau ..... 315/308
6,239,558 B1 * 5/2001 Fujimura et al. ..... 315/307

* cited by examiner

*Primary Examiner*—Don Wong
*Assistant Examiner*—Trinh Vo Dinh

(57) ABSTRACT

A fluorescent ballast and control circuit having a drive signal generator responsive to a drive frequency control signal, the drive signal generator providing a ballast drive signal having a drive signal frequency proportional to the drive frequency control signal. A fluorescent ballast is driven by the ballast drive signal and has an output voltage coupled to drive a fluorescent lamp load. The fluorescent ballast circuit provides a change in the output voltage applied to the lamp load in response to a change in the ballast drive signal frequency. A means for monitoring the brightness of the lamp load develops a brightness signal that characterizes the brightness of the lamp load. A signal conditioner responds to the brightness signal and to a reference signal and provides and adjusts a drive frequency control signal to keep the brightness signal substantially constant.

20 Claims, 7 Drawing Sheets

FLUORESCENT LAMP BRIGHTNESS CONTROL PROCESS BY BALLAST FREQUENCY ADJUSTMENT

BACKGROUND OF THE INVENTION

1. Field of the Invention

The present invention relates to the field of fluorescent drive ballast design and more particularly to the control of the drive voltage applied to a fluorescent lamp load by shifting the drive frequency the ballast driving the lamp load.

2. Description of Related Art

Recently, fluorescent lamps have been used for back lighting of LCD displays, typically in notebooks and other similar consumer applications as well as for military applications including GPS navigational aids. The lamps for such applications are small and are used alone or in combinations of up to four or more lamps depending on the size of the display. Such lamps have a maximum brightness range of 5:1, and their efficiency is slightly more important than for home or office lighting.

In military, industrial and law enforcement applications, LCD displays using fluorescent lamps are found in aircraft cockpits and other high technology applications. Such applications employ one to forty, or more, lamps in combination and represent examples of high-power density applications with 100 watts or more for a single 6"×9" display. The information displayed on such displays must be visible in direct sunlight and have a dimming range of over 500:1, and they must operate with high efficiency.

Prior art methods for dimming such light arrays typically vary the duty cycle of the AC drive to the lamp, while keeping the drive frequency constant, or they vary the current to the lamp while maintaining a 100% duty cycle.

SUMMARY OF THE INVENTION

A first advantage of the present invention is that it allows a wide range of control of the lamp's brightness, with no discontinuities or steps. The invention also compensates for the effects of temperature on the lamps and components, the effect of aging on the lamps and components, and the effects of input voltage line variations. Furthermore, it can be used in conjunction with other control methods such as pulse width modulation (PWM) to extend the dimming range.

The invention does so with minimal effects on cost, size and efficiency. Existing ballasts may be improved using this invention with no change to the major components, just by changing the way the components are controlled. This control may be handled in a single IC such as a microprocessor, which also incorporates all other control functions and so may not represent a cost increase.

Prior art requires significantly increasing the number of power components, which are large, costly, and waste power.

The invention automatically adjusts the voltage applied to the fluorescent lamp load so as to maintain a constant level of brightness out of the lamp load by sampling the light from the lamp load using an optical detector to develop a brightness signal, peak detecting the brightness signal and developing an error signal by comparing the brightness signal with a reference signal from a reference voltage source. The error signal is then integrated and the integrated error signal drives a voltage controlled oscillator to shift the operating frequency of a ballast drive circuit, as required, to drive the integrated error signal to zero.

In a preferred embodiment, the fluorescent ballast and control circuit comprises a drive signal generator that receives a drive frequency control signal. The drive signal generator provides a first and a second ballast drive signal. Each respective ballast drive signal is phase shifted to insure that they do not overlap in time. Each respective drive signal also has a substantially equal number of volt-seconds and a frequency proportional to the drive frequency control signal.

The fluorescent ballast and control circuit also comprises a fluorescent ballast circuit coupled to the ballast drive signals and having an output voltage coupled to drive a fluorescent lamp load. The fluorescent ballast circuit is characterized to provide a change in the output voltage applied to the lamp load in response to a change in the ballast drive signal frequency. The fluorescent ballast circuit has a transformer with a primary winding and a secondary winding. A totem-pole drive circuit is coupled to drive a first end of the primary winding in series with a resonant inductor. A second end of the primary winding is connected to ground. The secondary winding is connected in parallel with a resonant capacitor and the lamp load.

A means for monitoring the brightness of the lamp load and for developing a brightness signal characterizing the brightness of the lamp load is formed from a photo-cell or photodiode positioned to sense light rays from the lamp load and provide an optical signal characterizing the brightness of the lamp load in response to application of the ballast drive signal or drive pulses to the fluorescent ballast circuit input terminal during an on-time interval.

A signal conditioner is formed from a peak sample and hold circuit coupled to the brightness signal to sample and store the peak value of the brightness signal. The signal conditioner responds to the peak brightness signal and to a reference signal and provides and adjusts the drive frequency control signal to keep the brightness signal substantially constant.

The signal conditioner also has a summing amplifier that has a first input coupled to the reference signal and a second input coupled to be responsive to the peak brightness signal. The summing amplifier scales and outputs the difference between the peak brightness signal and the reference signal from scaled reference voltage source and outputs an error signal. An integrator has an input coupled to integrate the error signal and an output for outputting an integrated error signal. A range limit circuit responsive to the integrated error signal by clamping or limiting the range of the integrated error signal. The range limit circuit outputs the drive frequency control signal.

DETAILED DESCRIPTION

Figure 1:
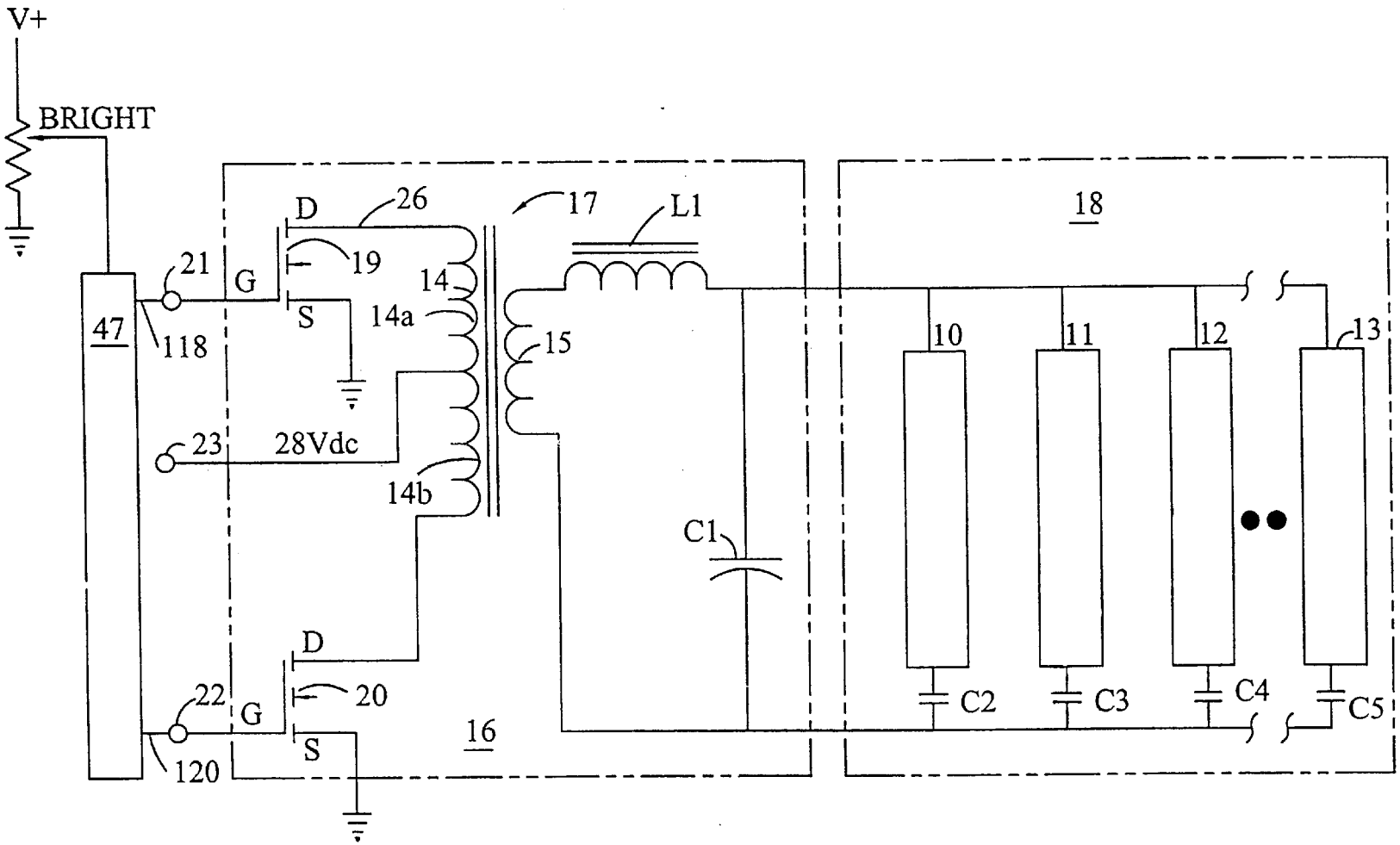
FIG. 1 is a schematic circuit diagram showing the conventional topology for a simplified push-pull driven semi-resonant fluorescent ballast circuit.

FIG. 1 shows the schematic diagram of a typical push-pull ballast drive circuit within phantom block 16 for driving a fluorescent lamp load depicted as a multiplicity of fluorescent lamps 10 through 13 within phantom block 18. As shown, the bottom of each of the lamps 10–13 is coupled via a respective capacitor dc blocking capacitor, C2, C3, C4, C5 to one side of secondary windings 15 of transformer 17. The other respective terminal of the lamps 10–13 is coupled in common through an inductor L1 or to the other side of the winding 15. A capacitor C1 or is coupled across the parallel connections of the lamps 10–13. The inductor L1 and capacitor C1, in combination with the lamp load, form a damped reactive load which when driven by the switch-mode drive from transformer 17 provides a quasi-sinusoidal drive to the lamp load.

The primary winding 14 of the transformer 17 is coupled to a pair of switching transistors 19 and 20. The transistors 19 and 20 are MOSFET's, or IGFETs each FET having a gate terminal G coupled to respective terminals 21 and 22 of the lamp power drive circuit. Terminal 23 is the center tap of the primary winding 14 and is further coupled to a dc source such as a 28 Vdc source. The drain terminal D of FET 19 is coupled to one side of the primary winding 14 and the drain terminal D of FET 20 is coupled to the other side of the primary winding 14. The respective sources S of FETs 19 and 20 are coupled to ground potential. In operation, a series of pulses are alternately applied to terminals 21 and 22 driving the FET switches into alternate on and off states. Operation of the FETs couples power to secondary winding 15.

Referring to FIG. 1, the invention control process and circuit resides within block 47. The circuit is described later in detail in connection with FIG. 4. Block 47, in FIG. 1, is shown receiving an operator controlled brightness signal called BRIGHT which may be used to control the initial duty ratio of the ballast. The control process and circuit of block 47 delivers pulses to the first and second primary windings 14*a*, 14*b* of transformer 17. The pulses are delivered in pairs of substantially equal duration so as to balance the volt-seconds applied to each winding to minimize any tendency to walk the core in a direction likely to produce high transient currents due to excess magnetizing current resulting from core saturation.

In a typical fluorescent ballast circuit design, the invention process and circuit of Block 47 would also be combined with a control process and circuitry (not shown in FIGS. 1–10) necessary for the Pulse Width Modulation Control (PWM) of the brightness of the lamp load. A PWM control is an industry standard technique for controlling the brightness of a fluorescent tube. The proposed invention may be used without PWM control, or work with PWM control. If used with PWM control, all of the advantage of PWM control and the proposed invention are maintained. If the PWM control is mechanized with a microprocessor or ASIC, it is likely that the same or similar microprocessor or ASIC can also implement and support the invention's processes.

Figure 2:
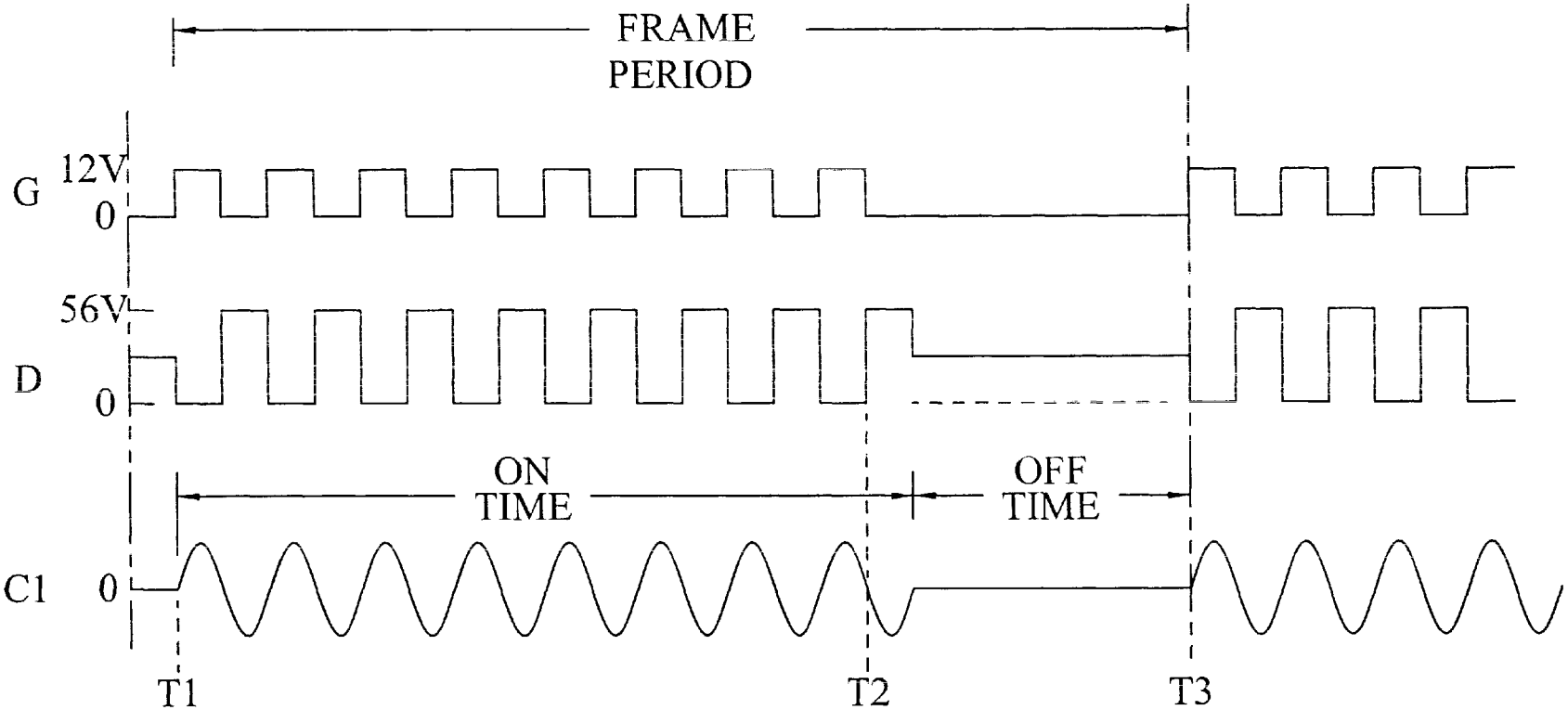
FIG. 2 provides a schematic characterization of the waveforms to be expected in a simplified push-pull driven semi-resonant fluorescent ballast circuit operating with a fixed frame rate and a variable duty cycle.

FIG. 2, schematically shows waveforms, as might be sampled from the invention control process and circuit within block 47 of FIG. 1, using a fixed frame rate and variable duty cycle control process. A fixed frame rate variable duty cycle control process is suitable for ballast circuit operation where the brightness of the lamp load is in excess of a predetermined brightness level typically in the mid-brightness range.

The gate drive signal G is a conventional quasi square wave applied to the gate terminals (G) of the top FET 19 shown in FIG. 1. The "on-time" occurs between time T1 and T2; and, the "off-time" occurs between time T2 and T3. In the fixed frame rate control process of FIG. 2, the "on-time" and "off-time" are variable. However, the sum of the "ON TIME" and the "OFF TIME" is the period of the frame, its reciprocal being the frame rate and frequency. In the fixed frame rate process, the frame rate is constant. A variable frame rate can be used for regulation in the brightness regime below the entry level set for a fixed frame rate process.

Waveform D of FIG. 2 represents the voltage wave form on the drain 26 of FET 19 in FIG. 1. As shown, the waveform on the drain is switched to ground or zero volts as the waveform at G goes high turning FET 19 "ON". The waveform D then rises to 56 volts, a voltage value twice the center tap voltage, as the gate voltage into 21 goes to ground turning FET 19 "OFF". FET 20 is driven "ON" at the same time by a positive going gate drive voltage into input 22. Waveform C1 illustrates the output voltage of the filter (i.e., L1 and C1) as applied to the lamps 10–13. A sine-wave is shown at the lamp drive frequency with the same "ON TIME" and "OFF TIME".

Compensation for Change of Brightness

In related art ballast drive circuits as described above, the duty cycle is typically set to obtain an average output-voltage value that is less than 100% of its maximum capability. As the lamp load ages, the average output voltage of the ballast is adjusted to a higher value. The average output voltage is typically increased by increasing the duty cycle or duty ratio, i.e., by increasing the ratio of the ON TIME to the total of the ON TIME and the OFF TIME intervals depicted in FIG. 2.

In the subject invention, the ratio of on time to off time, once adjusted for a given brightness level, remains constant as operating conditions (temperature, life, input voltage, etc.) vary. The variable drive frequency process of the subject invention typically operates with a 100% duty cycle at maximum specified lamp brightness, and provides a continuous and extended dimming and control range as the operating point on the reactance curve of the ballast is adjusted. The operator commands a change in the brightness of the lamps by using standard PWM control techniques. In this implementation, the value of the BRIGHT signal that is shown in FIGS. 1 and 4 is changed.

Figure 4:
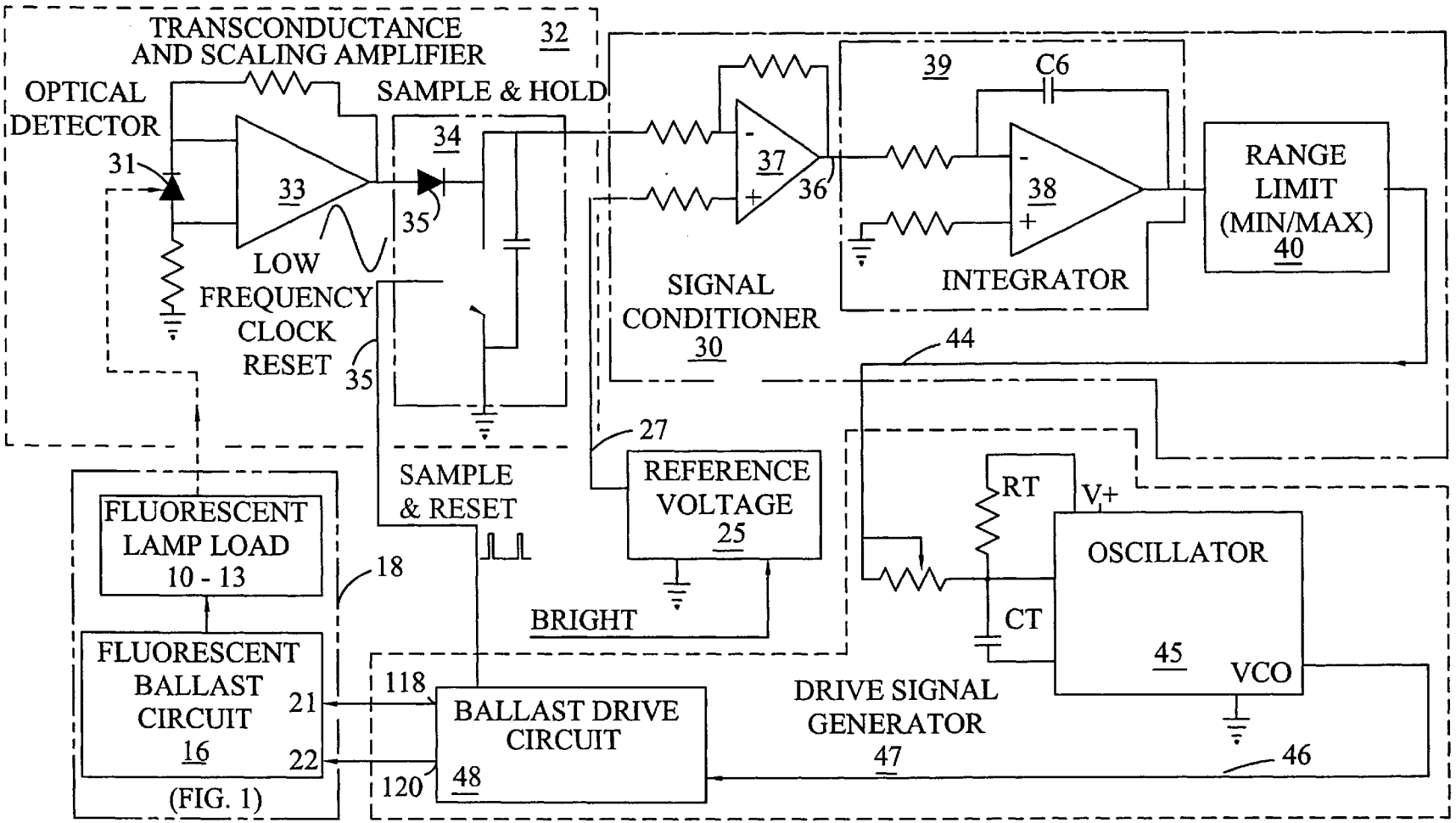
FIG. 4 is a schematic and block diagram of the control loop responsive to an optical detector for shifting the drive signal frequency source to maintain a constant brightness of the lamp load when pulsed by the ballast drive.

FIG. 4 shows the BRIGHT signal coupled to the reference voltage block 25. Block 25 responds to the BRIGHT signal by selecting and outputting a reference voltage on signal line 27 to a first input of signal conditioner 30.

Once the brightness is set using standard PWM control techniques the invention maintains the set brightness using it's own independent control method. This method adjusts the PWM frequency while keeping the duty cycle constant. Adjusting the PWM frequency adjusts the output voltage to the tubes independently of the duty cycle. The PWM control loop and the inventions frequency control loop are orthogonal, and with proper sensor techniques, as explained later, may be operated independently of one another.

Figure 3:
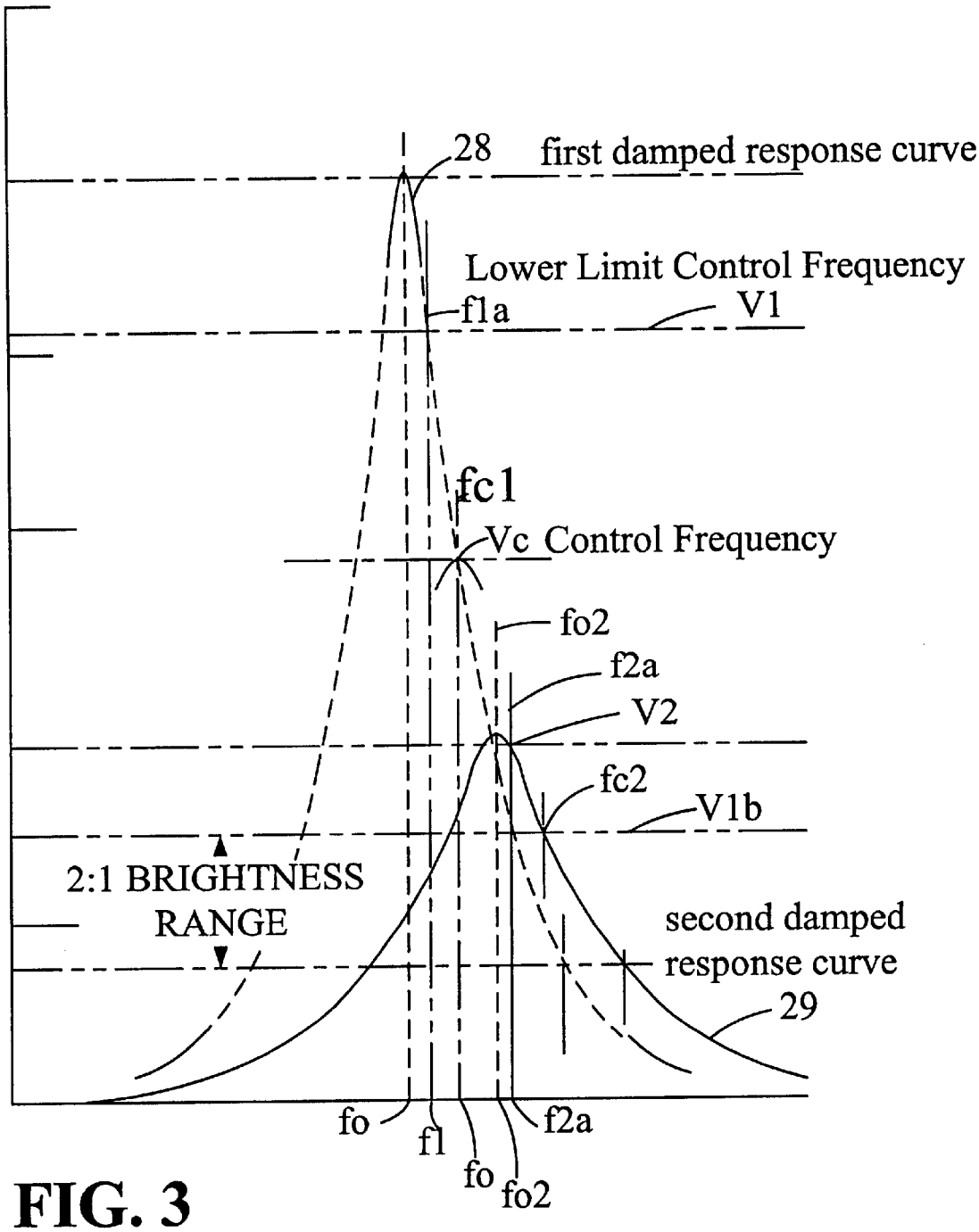
FIG. 3 is schematic graph of the Q of a fluorescent ballast as a function of pulse drive frequency for a light load and for a heavy load.

FIG. 3 shows a first damped resonant response curve 28 for a lightly loaded ballast and a second damped resonant response curve 29 for a heavily loaded ballast. The first damped resonant response curve 28 has a center resonant frequency at frequency fo1 while the second damped resonant response curve 29 has a center resonant frequency at fo2. In operation, a lightly loaded ballast adjusts the output voltage control frequency fc1 to a value that drives the output of the signal condition 30 to zero.

A lower limit control frequency f1*a* is established by error analysis and test that is close to but above the resonant frequency fo1 for all possible circuit operational conditions. The closed loop control loop of FIG. 4 adjusts the output voltage control frequency fc1 as required balance the loop. The range limit (min/max) block 40 has a predetermined threshold adjusted to clamp the output range of frequency of the oscillator, block 45, to not drop below the lower limit control frequency f1*a*. The first damped resonant response curve 28 of FIG. 3 shows that a maximum output voltage V1 is provided to the lamp load as the control frequency fc is lowered and approaches the lower limit control frequency f1*a*.

Curve 29 on FIG. 3, shows the effect of heavily loading the ballast curve. The center resonant frequency at fo2 has increased in response to the increase in lamp load. The nominal controlled drive frequency fc2 is raised accordingly. The lower limit control frequency f2*a* is positioned at a frequency above the center resonant frequency to a insure that the control range of controlled drive frequency fc2 is restricted to frequencies above the center resonant frequency fo2. A nominal output voltage Vc2 is provided to the lamp load and rises to a maximum of V2 as the control drive frequency fc2 is lowered and approaches the lower limit control frequency f2*a*.

The control frequency fc for a new lamp load is typically set to a value in a control range selected to provide the brightness that is required. As operating parameters such as lamp load efficiency, input voltage or component parameters vary, the brightness is maintained at a constant level by reducing the control frequency fc thereby increasing the voltage to the lamp load Vc. The values selected for a particular design with an a lower limit control frequency f1*a*, a Vc, a temperature range, a particular lamp load and ballast combination is a design choice and the subject of an error analysis. Where the combination of ballast drive circuit and load range is established, FIG. 3 implies that a table can be prepared that provides the relationship between center resonant frequency at fo1, load 1; fo2, load 2; fo3, load 3 and so on based on empirical test data. A center resonant frequency versus load table would make it possible to link the load selected to a particular a lower limit control frequency f1*a*, f1*b*. The design would thereby become adaptive, selecting its lower limit control frequency from a look-up table or calculating it from an algorithm before delivering power to the selected lamp load.

FIG. 4 is a schematic and block diagram for a fluorescent ballast and control circuit for brightness control that automatically compensates for lamp load aging by adjusting the ballast drive signal frequency to increase the applied voltage to the lamp load by moving the operating point of the ballast on its reactance curve, as required or as necessary, to hold the sampled peak brightness of the lamp load constant.

To maintain independent control of the invention process when used with a fluorescent ballast circuit implemented in combination with a PWM control process, the light out of the lamp load is peak sampled. The peak light output signal thus obtained is independent of the PWM modulator process. Optical detector 31, a photo-cell or PIN diode, is positioned to receives light rays from fluorescent tubes in the lamp load, such as those within phantom block 18 and which are also shown on FIG. 1. Block 32 contains a peak detector circuit formed from the transconductance amplifier 33 and the sample and hold circuit 34. The transconductance amplifier provides a bias source to the optical detector. Light rays from the lamp load 10–13 are received by the detector 31 which modulates the bias current, in response to the light rays, resulting in an output signal from the amplifier 33 to the sample and hold circuit 34. The sample-and-hold circuit is timed or reset periodically by a sample reset signal from ballast circuit 48. A capacitor in the sample and hold circuit 34 is charged via peak detection diode 35 which also blocks the discharge of the capacitor. The capacitor thereby holds the peak value of the brightness signal out of the output of transconductance amplifier 33 representing the brightness of the detected light rays.

Amplifier 37 receives the peak brightness signal on its inverting input and compares it to a reference voltage on its non-inverting input. The difference between the peak brightness signal from the Sample and Hold and the reference voltage input is amplified and provided as a scaled output voltage at output 36. The reference input is typically a fixed precision reference. However, a switch arrangement could be provided to allow the selection of a fixed precision reference using a selector switch and a resistance divider or a variable reference input with the switch in the variable position. In the alternative, the reference could be supplied from an adjustable pot driven from a precision reference (not shown) or from a source such as a digital to analog converter output from a microprocessor with access to a stored digital reference value (not shown).

The scaled output voltage at output 36 of amplifier 37 is an error signal. The error signal is delivered to the inverting input of Integrator 38. Integrator 38 responds to the error signal by slewing the integrator output voltage in an opposite polarity direction. The output of the integrator, block 39 is processed by the range limit (min/max) block 40 which clamps the output integrator, the integrated error signal, at predetermined limits of control range to provide the drive frequency control signal.

Figure 9:
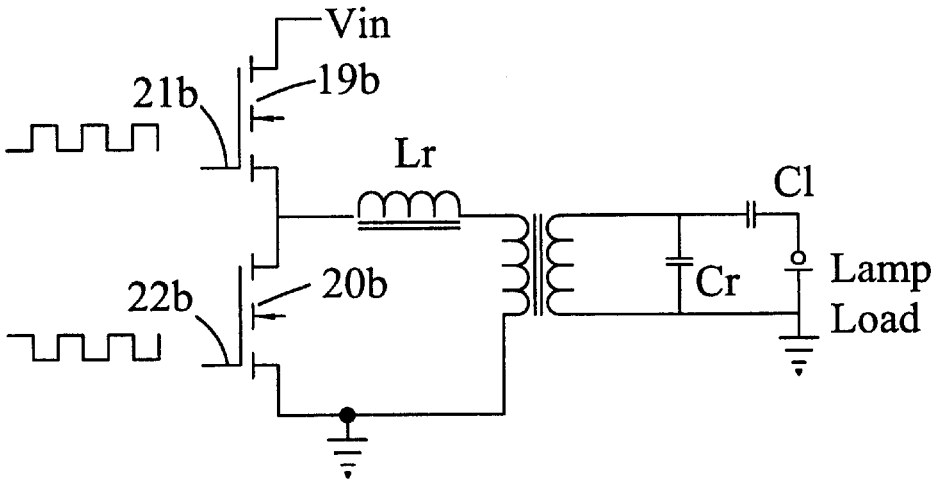
FIG. 9 shows a totem pole driven series combination of an inductor in series with a ground referenced transformer primary, the secondary driving a capacitor in parallel with a lamp load.

The output of block 40, the drive frequency control signal, is coupled via signal line 44 to the oscillator, block 45. Block 45 is a VCO (voltage controlled oscillator) that provides a ballast clock signal as clock pulses on signal line 46 to ballast drive circuit, block 48. Block 48 receives the clock pulses, and divides them by two into two, alternately phased, drive pulses on signal lines 118 and 120. The ballast drive circuit uses a flip-flop to provide the pairs of alternately phased pulses that comprise the drive signal. The output drive pulses are delivered to the ballast inputs 21 and 22 of block 16 and drive the ballast as described above in connection with FIG. 1. The drive switches of the ballast of FIG. 9 are numbered 19*b* and 20*b* and their respective gates are numbered 21*b* and 22*b* to suggest correspondence with equivalent nodes in FIGS. 1 and 4.

As the pulse rate out of the ballast drive circuit, block 48 increases in response to a change in the output of the integrator within phantom block 39, and in response to a corresponding change in the output of the oscillator, block 45, the operating point on the resonance curve of fluorescent ballast circuit, block 16, changes in accordance with a change in frequency as shown in FIG. 3. The change in operating point on the resonance curve of FIG. 3 results in a change in the voltage to the lamp load resulting in an increase or decrease in the brightness of the lamp.

The optical detector 31 monitors the brightness of the lamp load during each pulse GROUP of pulses to the lamp develops an optical signal characterizing the brightness of the lamp load. The optical detector 31 and the sample & hold block 34 samples and stores the peak value of the optical signal thereby performing the step of sensing the optical signal and scaling and buffering the optical signal to provide a scaled analog optical signal.

Amplifier 37 scales the difference voltage and outputs a reduced error signal at its output 36 to the input of integrator 39. As the error signal changes polarity, the output of the integrator 39 moves toward zero. The amplifier 37 and integrator 39 therefore perform the step of comparing the scaled analog optical signal with a predetermined reference signal into the second input to the amplifier 37 to develop an error signal that has a polarity that indicates that the brightness of the lamp load is above or below a predetermined brightness level.

The drive signal generator function within phantom block 47 responds to the drive frequency control signal on signal line 44 to provide a drive frequency control signal to the oscillator 45, i.e., a voltage controlled oscillator to adjust the drive signal frequency in response to the magnitude and polarity of the error signal to reduce the magnitude of the error signal to substantially zero. As the error signal approaches zero, the lamp load is maintained at a predetermined brightness level.

Figure 5:
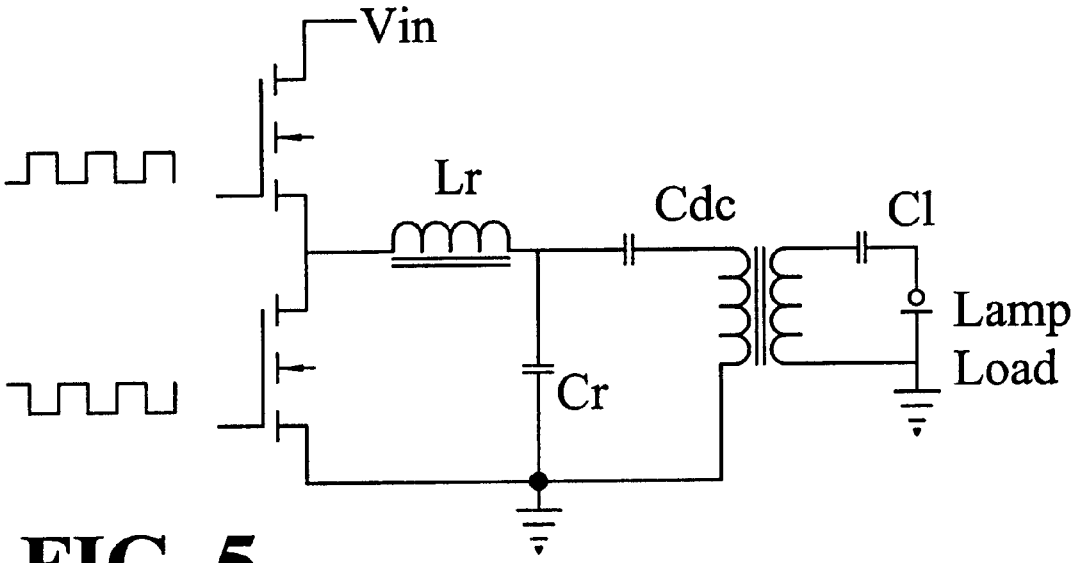
FIG. 5 is a schematic of a ballast using a totem-pole driven L/C section coupled to the second terminal of a ground referenced primary of an isolation transformer, the secondary driving a lamp load.

It should be understood that the process of providing a clock frequency adjust voltage or drive frequency control signal via signal line 41 in FIG. 4 to an oscillator such as oscillator 45 or to a drive signal generator to adjust the drive signal frequency in response to the magnitude and polarity of an error signal such as the error signal out of integrator 38 to reduce the magnitude of the error signal to substantially zero will work with almost any existing ballast topology. FIG. 5 shows a schematic of a first embodiment of a fluorescent ballast circuit selected from a class of fluorescent ballast circuit that provide a change in the voltage applied to the lamp load in response to a change in the number of drive pulses occurring within a constant on-time period. The fluorescent ballast circuit of FIG. 5 uses a totem pole drive with two FETs operating at a near 50/50 duty ratio. A resonating inductor Lr has a first terminal driven by the totem pole drive and a second terminal coupled to the first terminal of a resonating capacitor Cr. The second terminal of the capacitor Cr is coupled to ground. A blocking capacitor Cdc and the primary of an output transformer are coupled in series between the resonating inductor second terminal and ground. The secondary of the output transformer, a dc blocking and impedance limiting capacitor C1 and the lamp load are coupled in series in a loop and driven by an input to the primary of the transformer through blocking capacitor Cdc from the resonating inductor Lr second terminal.

Figure 6:
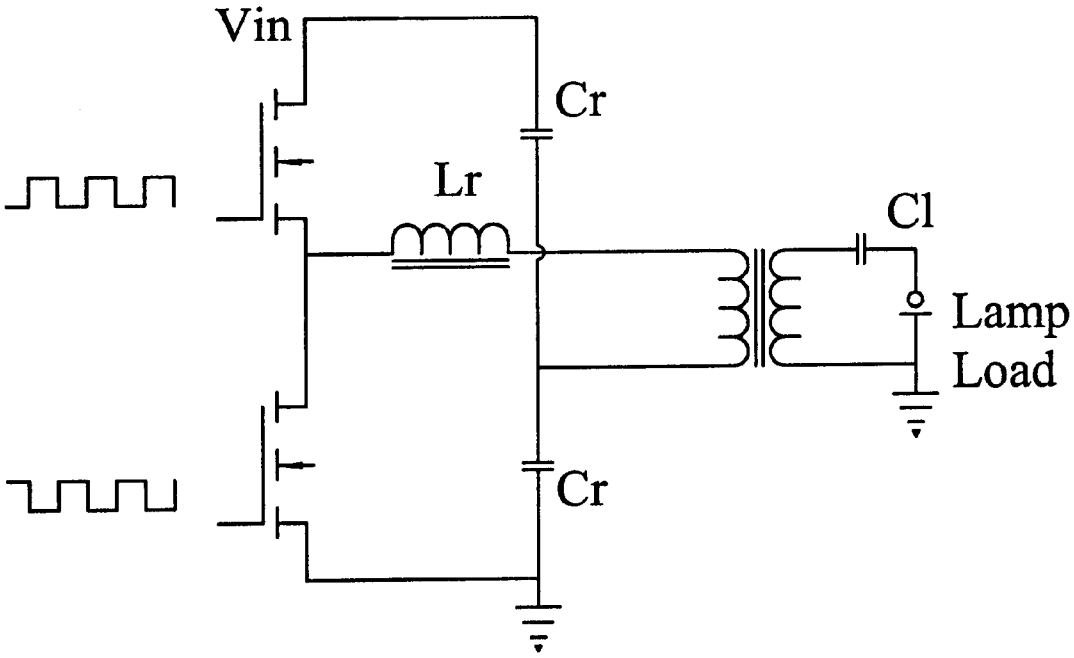
FIG. 6 is a schematic of a totem-pole driven inductor, the inductor being in series with a capacitor isolated transformer primary, a secondary driving a lamp load.

FIG. 6 shows a second embodiment of a fluorescent ballast circuit; a standard half-bridge implementation using two capacitors. A totem pole drive circuit is shown driving the first terminal of a resonating inductor Lr. The second terminal of the resonating inductor Lr is coupled to the first terminal of primary of a transformer. The first terminal of the first resonating capacitor is connected to the power supply Vin. The first terminal of the second resonating capacitor Cr2 is coupled to ground. The second terminal of the first and second resonating capacitors are coupled together and to the primary transformer second terminal. The second terminal of the primary of the transformer is coupled to the junction of two resonating capacitors, Cr1 and Cr2. The dc Blocking capacitor C1 is coupled in series with the secondary of the transformer and the lamp load.

Figure 7:
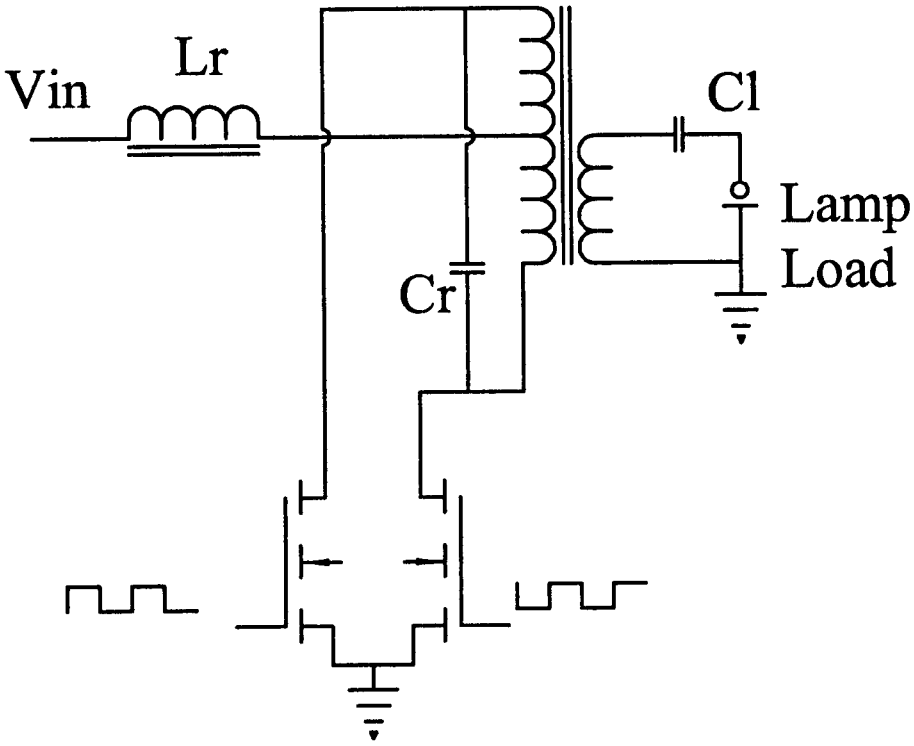
FIG. 7 shows a push-pull driven transformer primary, an inductor being in series with the primary center-tap and an input voltage source, a resonant capacitor being coupled across the entire primary, a secondary driving the a lamp load.

FIG. 7 shows a third embodiment of a fluorescent ballast circuit; an alternate approach using a transformer with a center-tapped primary. Resonant inductor Lr is coupled between the transformer primary center tap and the input power supply. The first and second ends of the primary winding are driven in the same way as in the circuit of FIG. 1. However, a resonating capacitor Cr is positioned across the primary. This is a common implementation, since it maximizes the step up ratio available from the primary to the secondary. The secondary is coupled to the lamp load through a dc blocking capacitor C1.

Figure 8:
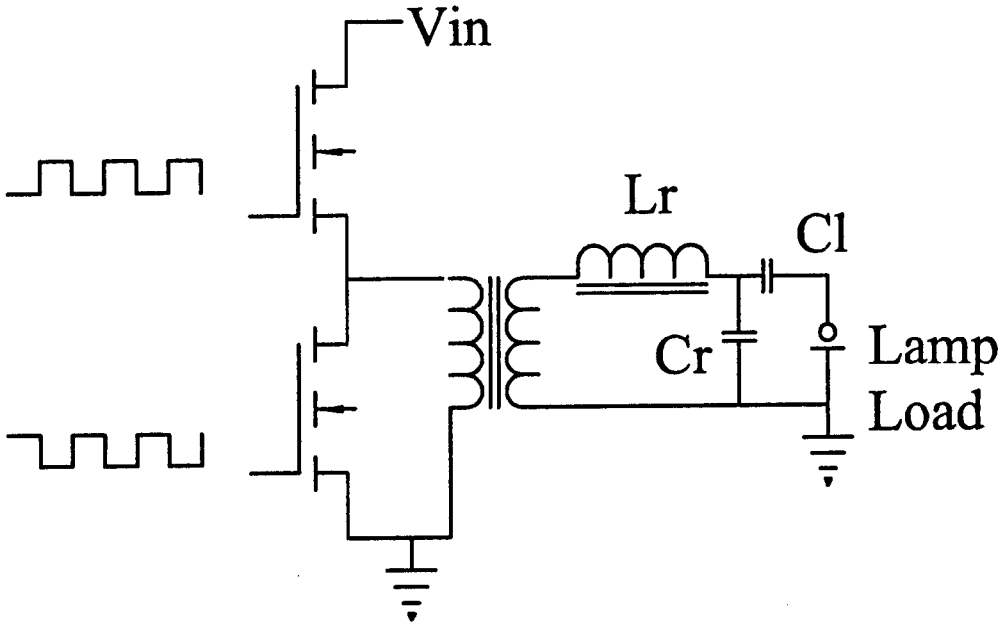
FIG. 8 is a schematic of a totem-pole driven, ground referenced transformer primary, a secondary driving a resonant L/C section, a lamp load being coupled to be in parallel across the capacitor.

FIG. 8 shows a fourth embodiment of a fluorescent ballast circuit; a totem pole FET drive to the first terminal of a primary winding, the second terminal of the primary winding being grounded. A secondary winding has a first terminal coupled to drive the first terminal of a resonating inductor Lr. The second terminal of the resonating inductor is coupled to the first terminal of a resonating capacitor and to the first terminal of a dc blocking capacitor C1. The second terminal of the dc blocking capacitor is coupled to the first terminal of the lamp load. The second terminal of the lamp load, the resonating capacitor Cr and the secondary winding of the transformer are common and connected to ground.

FIG. 9 shows a fifth embodiment of a fluorescent ballast circuit with a totem pole FET drive to the first terminal of a resonating inductor Lr. The second terminal of the resonating inductor is coupled to the first terminal of the primary of the transformer. The second terminal of the primary is grounded. The first terminal of the secondary of the transformer is coupled to the first terminal of a resonating capacitor Cr, and to the first terminal of a dc blocking capacitor C1. The second terminal of the dc blocking capacitor is coupled to the first terminal of the lamp load. The second terminal of the secondary winding of the transformer, the second terminal of the resonating capacitor Cr and the second terminal of the lamp load are common and connected to ground.

Figure 10:
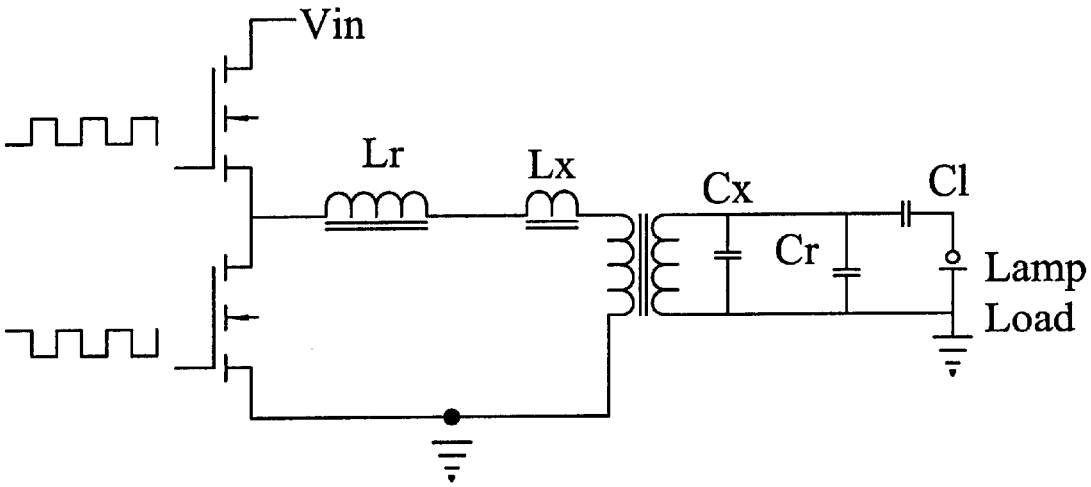
FIG. 10 shows a totem pole driven series combination of an inductor in series with a ground referenced transformer primary, the secondary driving a capacitor in parallel with a lamp load, similar to FIG. 9, with a series Lx and a parallel Cx.

FIG. 10 shows a totem pole FET drive to the first terminal of a resonating inductor Lr. The second terminal of the resonating inductor is coupled to the first terminal of an unknown inductor Lx, the modeled equivalent of the leakage inductance of the primary of a transformer. The second terminal of the modeled equivalent of the leakage inductance Lx is coupled to the first terminal of the primary of the transformer. The second terminal of the primary is grounded. The first terminal of the secondary of the transformer is coupled to the first terminal of an unknown capacitor Cx selected to model the winding-to-winding capacitance of the secondary, the first terminal of a resonating capacitor Cr, and the first terminal of a dc blocking capacitor. The second terminal of the dc blocking capacitor is coupled to the first terminal of the lamp load. The second terminal of the secondary winding of the transformer, the unknown capacitor Cx selected to model the winding-to-winding capacitance of the secondary, the second terminal of the resonating capacitor Cr and the second terminal of the lamp load are common and connected to ground.

From the topology of FIG. 10, it can be observed that the resonant inductor Lr for the circuit of FIG. 9 can be reduced in inductance by an amount equal to the measured value of Lx. It is also apparent from the topology of FIG. 10 that the required capacitance of resonant capacitor Cr can be reduced by an amount equal to the measured winding-to-winding capacitance of the secondary.

The topologies of FIGS. 5, 6, 7, 9 and 10 position the resonating inductor Lr in series with the primary where it is expected that it will be smaller because the sinusoidal voltage amplitudes on the primary are substantially less than the voltage required on the secondary. The peak energy stored in the resonating inductor is $\frac{1}{2}L*(I^2)$. The peak current is higher in on the primary side than on the secondary. Therefore, for a given inductance, and a given output load, the inductor size is minimized by a reduced volt-second support requirement and a higher energy storage per cycle because of the higher currents in the primary circuit.

Only the topologies of FIGS. 9 and 10 show the resonating capacitor Cr on the secondary side of the transformer and the resonating inductor Lr on the primary. The size of the capacitor will be smaller if it is located on the secondary because the peak energy stored in a capacitor is a function of $\frac{1}{2}C*(V^2)$ The transformer is a step up transformer with secondary voltages in excess of 1000 volts peak. If the cycle to cycle energy requirements are fixed for a given lamp load and if the voltage swing on the secondary side is in the kilovolt regime, it can be seen that capacitance can be reduced by positioning the resonating capacitor Cr on the secondary of the step up transformer as shown in FIG. 9 and FIG. 10.

The task of selecting a topology for a fluorescent ballast circuit requires consideration of those factors that will be considered important in the use of the resulting ballast. If the use mandates reduced weight and size, then of the topologies considered above, the topology of FIG. 9 and FIG. 10 offers the possibility of the highest output power to size ratio of the circuits of FIG. 5 to FIG. 9 and FIG. 10. Each of the topologies in the group use a resonant inductor Lr and a resonant capacitor Cr in a tuned arrangement characterized to provide a change in the voltage applied to the lamp load in response to a change in the number of drive pulses occurring within a constant on-time period. However, for a given output power, the circuit if FIG. 9 is most likely to achieve that goal with smallest size and lowest weight.

Design and Selection of Ballast Components

The design of a frequency-controlled ballast is similar to the design of a fixed frequency PWM controlled ballast. A fixed frequency PWM controlled ballast usually operates at a frequency near the resonant frequency established by the combination of the Lr and Cr output filter and output power to the lamp load is controlled by duty ratio or the switch on-time divided by the total of the on-time plus the switch off-time. However, a PWM controlled ballast can typically operate, without difficulty, at frequencies significantly above the resonant frequency of the Lr, Cr combination. The advantage of operating at the resonant frequency is that the voltage multiplication due to the "Q" is maximized while the advantage of operating at a frequency above resonance is that better waveform fidelity and lower switching losses (zero voltage switching) may be obtained.

The PWM ballast design procedure is a combination of analytical design coupled with some iterative and empirical procedures. The "Q" of the filter and the ratio of operating to resonant frequency determine the nominal step up in output voltage. A transformer is used to supply any extra step up required, since the "Q" alone will not obtain the high voltages required by the lamp load.

The output impedance Zo of the filter must be less than that of the total equivalent lamp impedance, or else the filter will be heavily damped and have a low "Q", with poor output waveforms. Zero voltage switching operation may not be obtained. However; if the output impedance is too low the circulating currents in the filter will too high, reducing efficiency and increasing the ratings (and therefore size) of the components.

An initial approach is to set to output impedance of the filter equal to the lamp impedance, and to then set the resonant frequency equal to the desired lamp drive frequency. Using the predetermined impedance and frequency, the procedure continues with a computation of the value of inductance and capacitance. The transformer step up ratio is approximately the ratio of the input voltage to output voltage.

Once the starting values are found, an equivalent, linear circuit is modeled using a circuit analysis program such as PSPICE by Orcad of Cadence Inc. A simplified model is used for the lamp load. An ac frequency response and transfer function (output voltage versus frequency) is then determined. The values of the components are adjusted to provide the desired output voltage.

The frequency-controlled ballast is operated at a point on the Lr, Cr resonant curve than normal for a fixed frequency PWM controlled ballast. In the design of a reasonably high "Q" frequency controlled ballast, the increase in frequency required above resonance or above that used for a fixed frequency ballast is minimal. Therefore the component selection is similar to that for the fixed frequency ballast if not identical. In most cases, a fixed frequency ballast may be operated in a frequency control mode with no change in component values.

For a frequency-controlled ballast with a closed control loop such as that shown in FIG. 4 with a ballast topology such as that of FIG. 9, the nominal output frequency is initially a value significantly above the Lr, Cr resonant frequency because the frequency must be increased or decreased within a range having predetermined limits to control the output voltage. There will be a necessary control range, which will depend on the operating conditions. For example, if it is desired to operate over a 2:1 variation in input voltage and a 2:1 variation of bulb brightness at end of life, a 4:1 control of the output voltage must be achievable. The "Q" of the circuit will determine how much frequency variation is required to achieve this control range and the solution may be approximated using PSPICE or empirically using a bread board.

Once a preliminary design is adopted, an accurate time dependent model of the circuit is then built and modeled using PSPICE and then an accurate breadboard or prototype is built so that the actual waveforms may be observed. Further component adjustments are made in response to empirical tests. Actual current and voltage measurements are made so that the components may be properly selected, stability, stress and thermal design limits determined.

It should be understood that although the design of FIG. 4 is an analog combination, with the exclusion of the of the photo detector, the Lr, Cr, C1 and voltage reference, and with the use of appropriate I/O and other interface circuitry such as analog to digital converters, flash converters and the like, the entire variable frequency control loop could be developed and modeled in software.

Those skilled in the art will appreciate that various adaptations and modifications of the preferred embodiments can be configured without departing from the scope and spirit of the invention. Therefore, it is to be understood that the invention may be practiced other than as specifically described herein, within the scope of the appended claims.

What is claimed is:

1. A method for fluorescent ballast and control process coupled to apply an output voltage to a fluorescent lamp load comprising steps of:

selecting and providing a fluorescent ballast circuit driven by a drive signal from a drive signal generator, the fluorescent ballast circuit providing a change in its output voltage to the lamp load in response to a change in a drive signal frequency and pulse;

monitoring the brightness of the lamp load with an optical detector positioned to be optically coupled to at least a ray of light from the fluorescent lamp load to develop a brightness signal characterizing the brightness of the fluorescent lamp load;

comparing the brightness signal with a reference signal to develop an error signal indicating that the brightness of the lamp load is above or below a predetermined brightness level; and providing a drive frequency control signal to the drive signal generator to adjust the drive signal frequency in response to the error signal to reduce the magnitude of the error signal, wherein, the brightness of the lamp load is maintained at a predetermined level.

2. The method of claim 1 wherein the step of selecting and providing a fluorescent ballast circuit, further comprises the step of selecting the fluorescent ballast circuit from those outputting a substantially sinusoidal voltage to the lamp load.

3. The method of claim 2 wherein the step of selecting and providing a fluorescent ballast circuit further comprises:

requiring that the ballast provide a change in its output voltage, applied to the lamp load, in response to a change in the drive signal frequency and to have a resonance responsive to the values of a resonance inductor and a resonance capacitor, the ballast operating at an operating point from which it moves to provide an increase in output voltage in response to a reduction in the drive signal frequency.

4. The method of claim 1 wherein the step of selecting and providing a fluorescent ballast circuit is further characterized to require that the ballast have a transformer having a primary winding and a secondary winding, a totem pole drive circuit coupled to drive the primary winding in series with a resonant inductor, the secondary winding being coupled in parallel with a resonant capacitor and the lamp load.

5. A fluorescent ballast and control circuit comprising:

a drive signal generator responsive to a drive frequency control signal for providing a ballast drive signal having a drive signal frequency proportional to the drive frequency control signal;

a fluorescent ballast circuit responsive to the ballast drive signal and having an output voltage coupled to drive a fluorescent lamp load, the fluorescent ballast circuit being characterized to provide a change in the output voltage applied to the lamp load in response to a change in the ballast drive signal frequency;

an optical detector positioned to be optically coupled to at least a ray of light from the fluorescent lamp load, the optical detector outputting a brightness signal corresponding to the brightness of the ray of light from the fluorescent lamp load; and a signal conditioner responsive to the brightness signal and to a reference signal for providing and adjusting the drive frequency control signal to keep the brightness signal substantially constant.

6. The fluorescent ballast and control circuit of claim 5 wherein the signal conditioner further comprises:

a peak sample and hold circuit coupled to the brightness signal for storing the peak value of the brightness signal and for providing a peak brightness signal, the signal conditioner responsive to the peak brightness signal and to a reference signal for providing and adjusting the drive frequency control signal to keep the brightness signal substantially constant.

7. The fluorescent ballast and control circuit of claim 5 wherein the signal conditioner further comprises:

a reference voltage source for providing the reference signal, a peak sample and hold circuit coupled to the brightness signal for storing the peak value of the brightness signal and for providing a peak brightness signal, an integrator having a first input coupled to the reference signal and a second input coupled to be responsive to the peak brightness signal, the integrator integrating the difference between the peak brightness signal and the scaled reference voltage source and for outputting the clock frequency control voltage.

8. The fluorescent ballast and control circuit of claim 5 wherein the signal conditioner further comprises:

a reference voltage source for providing the reference signal, a peak sample and hold circuit coupled to the brightness signal for storing the peak value of the brightness signal and for providing a peak brightness signal, a summing amplifier having a first input coupled to the reference signal and a second input coupled to be responsive to the peak brightness signal, the summing amplifier scaling and outputting the difference between the peak brightness signal and the scaled reference voltage source and for outputting an error signal, an integrator having an input coupled to integrate the error signal and an output for outputting the drive frequency control signal.

9. The fluorescent ballast and control circuit of claim 5 wherein the signal conditioner further comprises:

a reference voltage source for providing the reference signal, a peak sample and hold circuit coupled to the brightness signal for storing the peak value of the brightness signal and for providing a peak brightness signal, a summing amplifier having a first input coupled to the reference signal and a second input coupled to be responsive to the peak brightness signal, the summing amplifier scaling and outputting the difference between the peak brightness signal and the scaled reference voltage source and for outputting an error signal, an integrator having an input coupled to integrate the error signal and an output for outputting the integrated error signal, and a range limit circuit responsive to the integrated error signal for limiting the range of the integrated error signal and for outputting the drive frequency control signal.

10. The fluorescent ballast and control circuit of claim 5 wherein the drive signal generator further comprises:

a voltage controlled oscillator having an input coupled to be responsive to the drive frequency control signal, and an output providing a ballast clock signal, and a ballast drive circuit having an input responsive to the ballast clock signal and an output providing the ballast drive signal to the fluorescent ballast circuit.

11. The fluorescent ballast and control circuit of claim 10 wherein the ballast drive circuit is toggled by the ballast clock signal, the ballast drive circuit having a first and second output providing first and second ballast drive signal pulse outputs to the fluorescent ballast circuit.

12. The fluorescent ballast and control circuit of claim 10 wherein the ballast drive circuit further comprises:

an input responsive to the ballast clock signal and first and second outputs for providing complementary ballast drive signals to the fluorescent ballast circuit.

13. The fluorescent ballast and control circuit of claim 5 further comprises:

a peak sample and hold circuit coupled to the brightness signal for storing the peak value of the brightness signal and for providing a peak brightness signal, the signal conditioner being responsive to the peak brightness signal and to the reference signal for providing and adjusting the drive frequency control signal to keep the brightness signal substantially constant.

14. The fluorescent ballast and control circuit of claim 5 wherein the fluorescent ballast circuit further comprises:

a transformer having a primary winding and a secondary winding, a totem pole drive circuit being coupled to drive a first end of the primary winding in series with a resonant inductor, a second end of the primary winding being coupled to ground, the secondary winding being coupled in parallel with a resonant capacitor and the lamp load.

15. A fluorescent ballast and control circuit comprising:

a drive signal generator responsive to a drive frequency control signal for providing a first and a second ballast drive signal, each respective ballast drive signal being phase shifted to insure that they do not overlap in time, each respective drive signal having a substantially equal number of volt-seconds and a frequency proportional to the drive frequency control signal;

a fluorescent ballast circuit responsive to the ballast drive signal and having an output voltage coupled to drive a fluorescent lamp load, the fluorescent ballast circuit being characterized to provide a change in the output voltage applied to the lamp load in response to a change in the ballast drive signal frequency and having, a transformer having a primary winding and a secondary winding, a totem pole drive circuit being coupled to drive a first end of the primary winding in series with a resonant inductor, a second end of the primary winding being coupled to ground, the secondary winding being coupled in parallel with a resonant capacitor and the lamp load, an optical detector positioned to be optically coupled to at least a ray of light from the fluorescent lamp load, the optical detector outputting a brightness signal corresponding to the brightness of the ray of light from the fluorescent lamp load, and a signal conditioner responsive to the brightness signal and to a reference signal for providing and adjusting the drive frequency control signal to keep the brightness signal substantially constant.

16. The fluorescent ballast and control circuit of claim 15 wherein the signal conditioner further comprises:

a peak sample and hold circuit coupled to the brightness signal for storing the peak value of the brightness signal and for providing a peak brightness signal, the signal conditioner responsive to the peak brightness signal and to a reference signal for providing and adjusting the drive frequency control signal to keep the brightness signal substantially constant.

17. The fluorescent ballast and control circuit of claim 15 wherein the signal conditioner further comprises:

a reference voltage source for providing the reference signal, a peak sample and hold circuit coupled to the brightness signal for storing the peak value of the brightness signal and for providing a peak brightness signal, a summing amplifier having a first input coupled to the reference signal and a second input coupled to be responsive to the peak brightness signal, the summing amplifier scaling and outputting the difference between the peak brightness signal and the scaled reference voltage source and for outputting an error signal, an integrator having an input coupled to integrate the error signal and an output for outputting the integrated error signal, and a range limit circuit responsive to the integrated error signal for limiting the range of the integrated error signal and for outputting the drive frequency control signal.

18. The fluorescent ballast and control circuit of claim 15 wherein the drive signal generator further comprises:

a voltage controlled oscillator having an input coupled to be responsive to the drive frequency control signal, and an output providing a ballast clock signal, and a ballast drive circuit having an input responsive to the ballast clock signal and an output providing first and second complementary ballast drive signals to the fluorescent ballast circuit.

19. The fluorescent ballast and control circuit of claim 18 wherein the ballast drive circuit is toggled by the ballast clock signal, the ballast drive circuit having a first and second output providing first and second ballast drive signal pulse outputs to the fluorescent ballast circuit.

20. The fluorescent ballast and control circuit of claim 15 wherein the means for monitoring the brightness of the lamp load and for developing the brightness signal further comprises:

a peak sample and hold circuit coupled to the brightness signal for storing the peak value of the brightness signal and for providing a peak brightness signal, the signal conditioner being responsive to the peak brightness signal and to the reference signal for providing and adjusting the drive frequency control signal to keep the brightness signal substantially constant.

* * * * *